United States Patent [19]

Pitts

[11] Patent Number: 4,830,268

[45] Date of Patent: May 16, 1989

[54] ADJUSTABLE FILE FOLDER

[75] Inventor: Warren R. Pitts, Needham, Mass.

[73] Assignee: Dennison Manufacturing Company, Framingham, Mass.

[21] Appl. No.: 707,974

[22] Filed: Mar. 4, 1985

[51] Int. Cl.[4] ..... B65D 5/44

[52] U.S. Cl. ..... 229/68 R; 40/359; 229/DIG. 3; 493/947

[58] Field of Search ..... 229/1.5, 68 R, DIG. 3; 493/947; 40/359; 312/321

[56] References Cited

U.S. PATENT DOCUMENTS

| | | | |
|---|---|---|---|
| 2,291,724 | 8/1942 | Jonas | 312/321 |
| 2,312,717 | 3/1943 | Jonas | 40/359 |
| 3,297,232 | 1/1967 | Fesco | 229/DIG. 3 |
| 3,414,185 | 12/1968 | Young | 229/68 R |
| 3,817,444 | 6/1974 | Yoch | 229/DIG. 3 |
| 4,053,057 | 10/1977 | Snowden | 40/359 X |
| 4,274,577 | 6/1981 | Walsh | 229/1.5 R |

FOREIGN PATENT DOCUMENTS

| | | | |
|---|---|---|---|
| 943614 | 12/1963 | United Kingdom | 229/DIG. 3 |

*Primary Examiner*—Stephen Marcus
*Assistant Examiner*—B. Gehman
*Attorney, Agent, or Firm*—Arthur B. Moore; Gary S. Winer

[57] ABSTRACT

An adjustable folder is disclosed with an overlap to accomodate variable contents. As the quantity of filed paper exceeds the current size of the folder, the overlap is moved to provide additional capacity.

5 Claims, 3 Drawing Sheets

ADJUSTABLE FILE FOLDER

BACKGROUND OF THE INVENTION

The present invention relates to file folders, and more particularly to file folders having an adjustable storage capacity.

Numerous types of file folders are known, which comprise an elongated rectangular panel folded roughly at the center forming a protective container for papers. There are generally two major types, designated here as common and hanging.

In the common type, folders are stacked in abutting conformity in a file drawer, and are maintained in an upright position by adjacent folders. As individual folders fill with papers, the bottom of the folder flattens out, shortening either or both sides. This has the effect of impairing the protective function of the folder. Moreover, papers are more likely to fall out of the attenuated folder.

The hanging type includes elongated bars having hooked shaped ends, as shown in U.S. Pat. No. 2,291,724. A bar is installed in each end of the folder, wherein the file is suspended from edges in the file drawer. As these folders fill with papers, the file sides are forced apart.

Consequently, the bottom becomes wider and the sides become shorter. Since the sides are maintained at a fixed height in the file drawer, the papers rise up out of the folder. These papers catch on the cabinet as one opens and closes the file drawer, thus damaging the file. Moreover, the papers are inadequately protected and confined.

It is therefore an object of the invention to provide a folder which is adjustable in size, thereby affording adequate protection and confinement to greatly varying amounts of filed papers.

It is a further object of the invention to provide such a folder at a low cost, and of simple construction.

SUMMARY OF THE INVENTION

In accomplishing the foregoing and related objects, the invention provides an adjustable file with an overlap to accomodate variable contents. As the quantity of filed paper exceeds the current size of the folder, the overlap is moved to provide additional capacity.

In accordance with one aspect of the invention, a folder is formed frm an elongated flexible rectangular panel fanfolded over a portion of its length, wherein the fanfolded portion is reversibly fastened. When the amount of filed papers fills the folder, the fold is unfastened, thereby increasing the length of the panel.

In one embodiment the fanfold is fastened with brass paper fasteners installed through aligning apertures in the fold. Other reversible fasteners which may be used include strips, clips, or snaps. For even greater adjustability, more than one fold may be provided, each fold being unfastened when additional storage space is needed.

In accordance with another aspect of the invention, at least one flexible rectangular panels are overlapped to form the folder. The panels are reversibly fastened, permitting varying levels of overlap, thus the overall length of the resultant panel is alterable. In a preferred embodiment, the panels include a series of apertures alignable with the apertures of superposed panels. In one embodiment, brass paper fasteners are installed through the apertures to reversibly join the panels.

In accordance with another aspect of the invention, the embodiments of the invention are provided in a folder of the hanging type. Elongated rods having hook shaped ends are installed at opposite ends of the folder.

In accordance with a further aspect of the invention, two folders share a common central hanging bar, thus increasing capacity while reducing cost.

BRIEF DESCRIPTION OF THE DRAWINGS

Other aspects of the invention will become apparent after considering several illustrative embodiments taken in conjunction with the accompanying drawings in which.

DETAILED DESCRIPTION OF THE INVENTION

Figure 1:
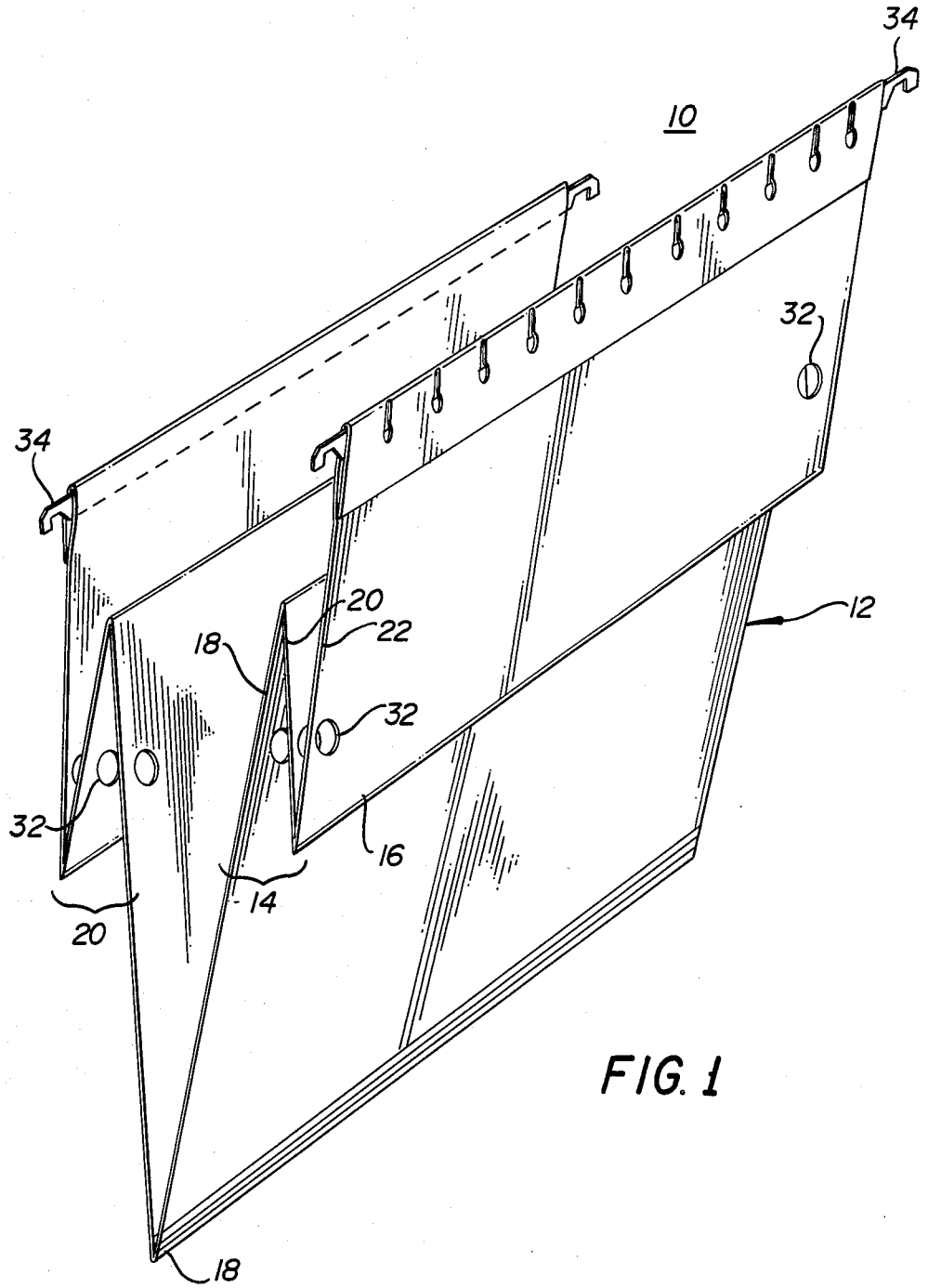
FIG. 1 is a perspective view of a fanfolded embodiment in accordance with the invention.
Figures 2, 2A:
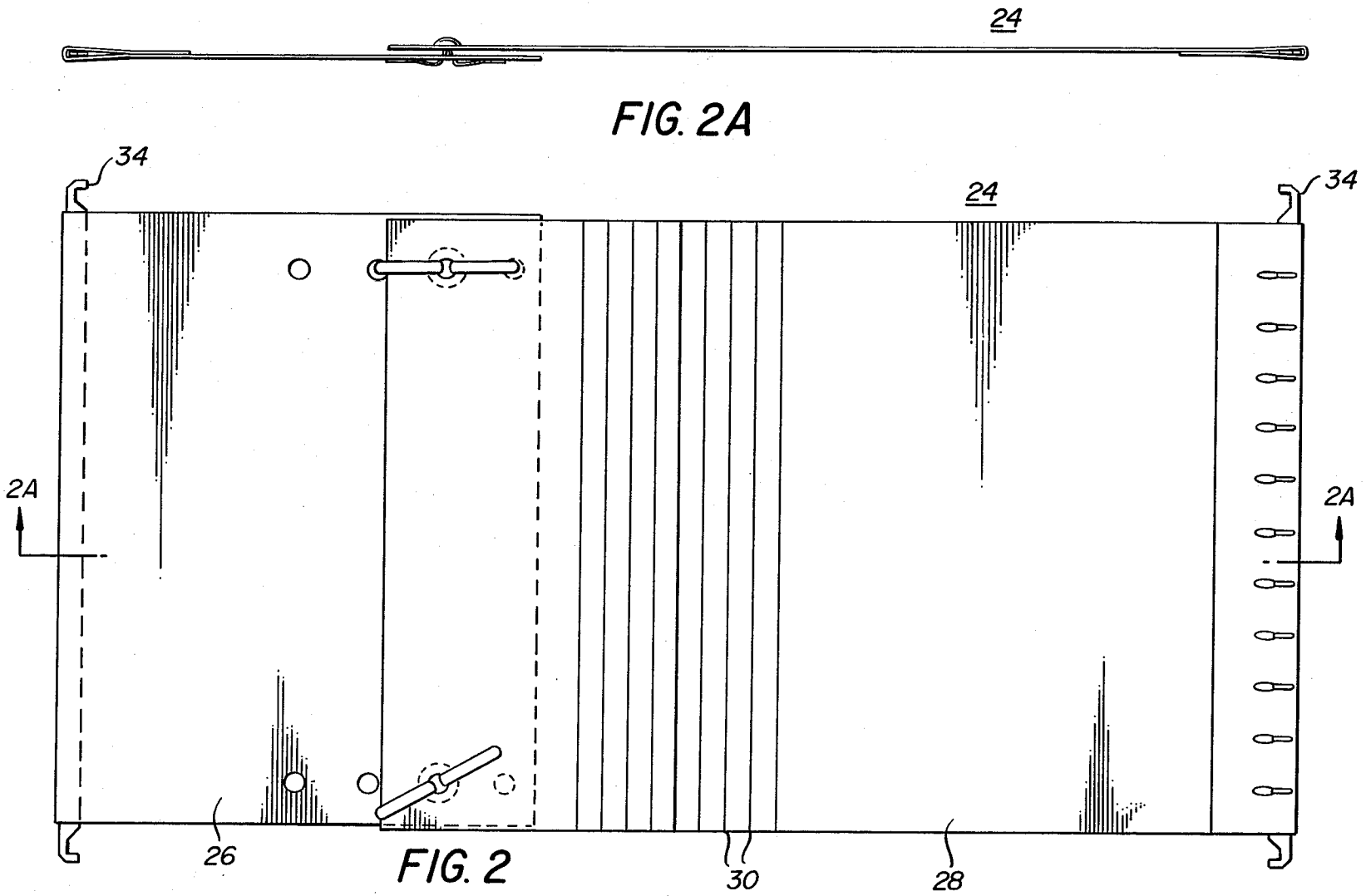
FIG. 2 is a perspective view of an overlapped panel embodiment of the invention.
FIG. 2A is a section view taken along line 2A—2A of FIG. 2.
Figure 3:
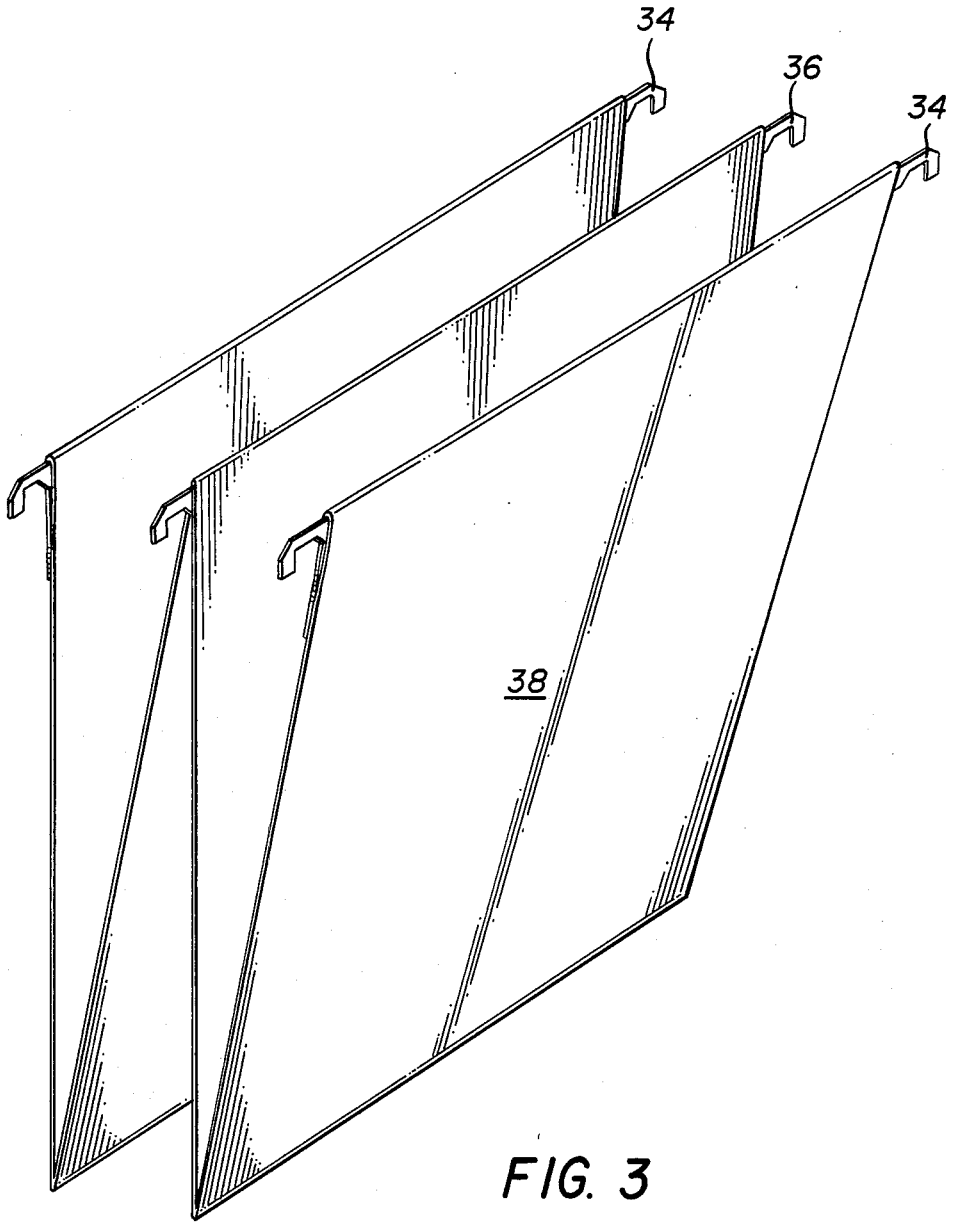
FIG. 3 is a perspective view of a joined file in accordance with the invention.

With reference to FIGS. 1-3, the invention provides a file folder of variable capacity. In one embodiment, the file is folded upon itself, whereupon the fold may be undone to expand the file. In another embodiment, the file comprises overlapping panels. In each embodiment, additional material is reserved to be used when the file contents exceed the unextended capacity.

As shown in FIG. 1, a folder 10 in accordance with the present invention includes an elongated rectangular flexible panel 12. The composition of panel 12 may vary widely, but typically includes paper, cardboard, fiberboard, plastic, and laminates thereof. Fold 14 is formed by fanfolding a portion of panel 12. The fanfold, or Z fold, is created by folding the end of panel 12, then folding at a lower point in an opposite direction, along the same axis.

As folder 10 fills, there becomes a potential for the piling up of papers, as occurs in the prior art. At this juncture, fold 14 is expanded to increase the available length of panel 12, permitting the bottom edge 18 of folder 10 to flatten, thus permitting the accomodation of more papers.

If great increases in file size is expected, an additional fold 20 may be added, preferably disposed on the opposite face of the folder. More than one fold per side may be provided if the folds are of appropriate length.

In an alternative embodiment, shown in FIG. 2, folder 24 comprises two flexible rectangular panels 26, 28, which are superposed and fastened. The degree of overlap determines the length of the resultant elongated rectangular panel. The panel is then folded in half to form a file folder. Creases 30 are provided to facilitate folding as well as to encourage papers to align.

Reversible fastening of the embodiments shown in FIGS. 1 and 2 may be achieved in a variety of ways, including the use of brass paper fasters, clips, VELCRO strips, and snaps. A particularly advantageous method is the use of brass paper fasteners, as shown in FIGS. 1 and 2. These fasteners include a plurality of malleable leaves which extend from a widened head portion.

In FIG. 1, apertures 32 are disposed in the folds. When sections 16, 18, and 20 are pressed together, a brass paper fastener may be installed through apertures 32, thus binding the fold. In the embodiment shown in FIG. 1, four fasteners would be installed to fasten folds 14 and 20.

In FIG. 2, panel 26 is provided with a plurality of spaced apart apertures. Panel 28 contains a plurality of apertures alignable with those of panel 26. The folder size is adjusted by first aligning apertures when the desired degree of overlap is established, and then installing the fasteners in the aligning holes.

VELCRO or snaps may be used by placing mating segments in alignable locations in the fold, as in FIG. 1, or by placing mating segments on panels 26 and 28, as in FIG. 2.

Non-reversible fasteners such as staples may be used in each embodiment. In the embodiment shown in FIG. 1, the folds may be restapled if the file contents decrease significantly. In the embodiment shown in FIG. 2, the panels are refastened.

The folders of the present invention provide great advantage in hanging file systems. As shown in the figures, elongated bars 34, having hooked shaped ends, are disposed about the opposite ends of the folder. Bars 34 serve as hangers, wherein the hooks rest on edges within the file drawer. The present invention has particular applicability in hanging file systems, particularly due to the fact that prior art folder height is non-alterable. In contrast, folder height according to the present invention is completely adjustable. For example, a conventional folder may be provided with fold 14 to form a shortened file, ideal for filing index cards or the like. Alternatively, an elongated folder may be formed, having a plurality of folds, thus capable of significant expansion. Folder size may be further increased, while reducing production costs, by employing a common hanging bar 36, thus generating two-part folder 38, as shown in FIG. 3. Moreover, the folder 38 may be provided with the fold shown in FIG. 1, or the mating panels of FIG. 2, to provide further adjustability.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. A folder comprising:

a panel with an intermediate overlap on one side; and means for adjusting the overlap, including elimination thereof, said overlap is provided with a plurality of apertures; and said folder further comprising fastening means cooperative with said apertures.

2. The folder of claim 1, wherein said panel comprises:

a first member provided with a plurality of apertures; and a second member provided with a plurality of apertures alignable with the apertures of said first member.

3. The folder of claim 2, further comprising:

a plurality of fasteners cooperative with said apertures to maintain said members in a superposed relationship;

wherein apertures may be realigned to alter the relationship of the superposed members.

4. The folder of claim 3 wherein said fasteners comprise brass paper fasteners.

5. The folder of claim 1 wherein said overlap is a fanfold.

* * * * *